US006941995B2

(12) United States Patent
Hsu

(10) Patent No.: US 6,941,995 B2
(45) Date of Patent: Sep. 13, 2005

(54) LACE-LIKE STRUCTURE OF A HIVE-SHAPED VENETIAN BLIND

(75) Inventor: Pey-Son Hsu, Changhua Hsien (TW)

(73) Assignee: Ching Feng Blinds Ind. Co., Ltd, Changhua Hsien (TW)

( * ) Notice: Subject to any disclaimer, the term of this patent is extended or adjusted under 35 U.S.C. 154(b) by 0 days.

(21) Appl. No.: 10/449,120

(22) Filed: Jun. 2, 2003

(65) Prior Publication Data

US 2004/0238130 A1 Dec. 2, 2004

(51) Int. Cl.[7] ..... A47H 5/00
(52) U.S. Cl. ..... 160/84.05; 160/84.01
(58) Field of Search ..... 160/84.05, 84.01, 160/84.03, 84.07, 168.1 R, 173 R, 178.1 R, 178.3 R; 256/1, 34; 156/70, 73.1, 197

(56) References Cited

U.S. PATENT DOCUMENTS

| | | | | | |
|---|---|---|---|---|---|
| 2,083,681 | A | * | 6/1937 | Baldwin | 52/473 |
| 2,103,271 | A | * | 12/1937 | Pratt | 160/236 |
| 2,726,830 | A | * | 12/1955 | Brown et al. | 181/210 |
| 4,227,305 | A | * | 10/1980 | Newman | 30/229 |
| 5,184,801 | A | * | 2/1993 | Finkelstein | 256/34 |
| 5,339,882 | A | * | 8/1994 | Judkins | 160/84.05 |
| 5,558,925 | A | * | 9/1996 | Fritzman | 428/181 |
| 5,584,468 | A | * | 12/1996 | Meglino et al. | 256/34 |
| 5,806,839 | A | * | 9/1998 | Meglino | 256/34 |
| 6,019,864 | A | * | 2/2000 | Jones | 156/258 |
| 6,206,075 | B1 | * | 3/2001 | Prince et al. | 160/84.05 |
| 6,319,586 | B1 | * | 11/2001 | Colson | 428/116 |
| 6,497,266 | B1 | * | 12/2002 | Palmer et al. | 160/236 |
| 6,527,895 | B1 | * | 3/2003 | Palmer | 156/197 |
| 6,568,453 | B2 | * | 5/2003 | Zorbas | 160/84.05 |
| 6,634,409 | B2 | * | 10/2003 | Corey et al. | 160/236 |
| 6,688,373 | B2 | * | 2/2004 | Corey et al. | 160/236 |
| 6,740,389 | B2 | * | 5/2004 | Yu | 428/116 |
| 6,792,996 | B1 | * | 9/2004 | Yu et al. | 160/176.1 R |
| 2001/0001405 | A1 | * | 5/2001 | Rupel et al. | 156/73.1 |
| 2002/0043346 | A1 | * | 4/2002 | Zorbas | 160/84.05 |
| 2002/0113232 | A1 | * | 8/2002 | Torres | 256/34 |
| 2004/0007310 | A1 | * | 1/2004 | Hsu | 156/70 |
| 2004/0079493 | A1 | * | 4/2004 | Yu | 160/84.05 |
| 2004/0216851 | A1 | * | 11/2004 | Yu et al. | 160/84.04 |

FOREIGN PATENT DOCUMENTS

| | | | | | |
|---|---|---|---|---|---|
| KR | 2002/011258 | A | * | 8/2000 | 160/84.05 X |

* cited by examiner

*Primary Examiner*—Bruce A. Lev
(74) *Attorney, Agent, or Firm*—Troxell Law Office, PLLC

(57) ABSTRACT

A lace-like structure of a hive-shaped Venetian blind comprises a blind body made up of a plurality of wave-like arc slats paired up into oval-shaped blind units in cross section. Each wave-like arc slat has a pair of extended flanges disposed at the front and rear sides thereof. Rollers with lace-producing convex edges disposed thereon are adapted to clamp tight the extended flanges thereof and synchronically seal up the pair-up wave-like arc slats via ultrasonic welding art with lace-like patterns cut at the extended flanges thereon via the lace-producing convex edges thereof. Thus, via the lace-producing rollers, the blind body thereof are automatically and synchronically assembled in ready and speedy manner to provide a Venetian blind with lace-like patterns disposed at the front and rear sides thereof in beautiful display.

2 Claims, 4 Drawing Sheets

LACE-LIKE STRUCTURE OF A HIVE-SHAPED VENETIAN BLIND

BACKGROUND OF THE INVENTION

The present invention is related to a lace-like structure of a hive-shaped Venetian blind, comprising a blind body made up of a plurality of wave-like arc slats paired up into oval-shaped blind units in cross section. Each wave-like arc slat includes a pair of extended flanges disposed at the front and rear sides thereof. Rollers with lace-producing convex edges disposed thereon are adapted to clamp tight the extended flanges thereof and synchronically seal up the pair-up wave-like arc slats via ultrasonic welding art with lace-like patterns cut at the extended flanges thereon via the lace-producing convex edges thereof. Thus, the blind body thereof is easily and readily assembled to provide a Venetian blind with lace-like patterns disposed at the front and rear sides thereof in beautiful display.

Please refer to FIG. 1. A conventional hive-shaped Venetian blind comprises a blind body 10 attached to an upper and a lower beam 11, 12 there-between. The blind body 10 is made up of a plurality of equal spaced and hive-shaped blind units 13 wherein each hive-shaped blind unit 13 is attached to the others via a fixing plate 14. The blind body 10 thereof is gathered up or unfolded via a pull cord 15.

There are some drawbacks to such conventional hive-shaped Venetian blind. First, the blind body 10 is made up of the hive-shaped blind units 13 individually bound together via fixing plates 14, which is not only troublesome and time-consuming in assembly, and also uncompetitive in the market. Second, the blind body 10 is made up of the simple hive-shaped blind units 13, which is rather plain in decoration.

SUMMARY OF THE PRESENT INVENTION

It is, therefore, the primary purpose of the present invention to provide a lace-like structure of a hive-shaped Venetian blind, comprising a blind body made up of a plurality of wave-like arc slats paired up into oval-shaped blind units in cross section. Each wave-like arc slat has a pair of extending flanges disposed at the front and rear sides thereof. Rollers with lace-producing convex edges disposed thereon are adapted to clamp tight the extended flanges thereof and synchronically seal up the pair-up wave-like arc slats to form the blind body thereof in a ready and speedy manner, facilitating the massive production of the Venetian blind thereof.

It is, therefore, the secondary purpose of the present invention to provide a lace-like structure of a hive-shaped Venetian blind wherein the extended flanges of the paired-up wave-like arc slats, clamped by the rollers, are synchronically sealed up via ultrasonic welding art with lace-like patterns cut thereon via the lace-producing convex edges of the rollers to increase the overall beauty of the blind body thereof in display.

DETAILED DESCRIPTION OF THE PREFERRED EMBODIMENTS

Figure 1:
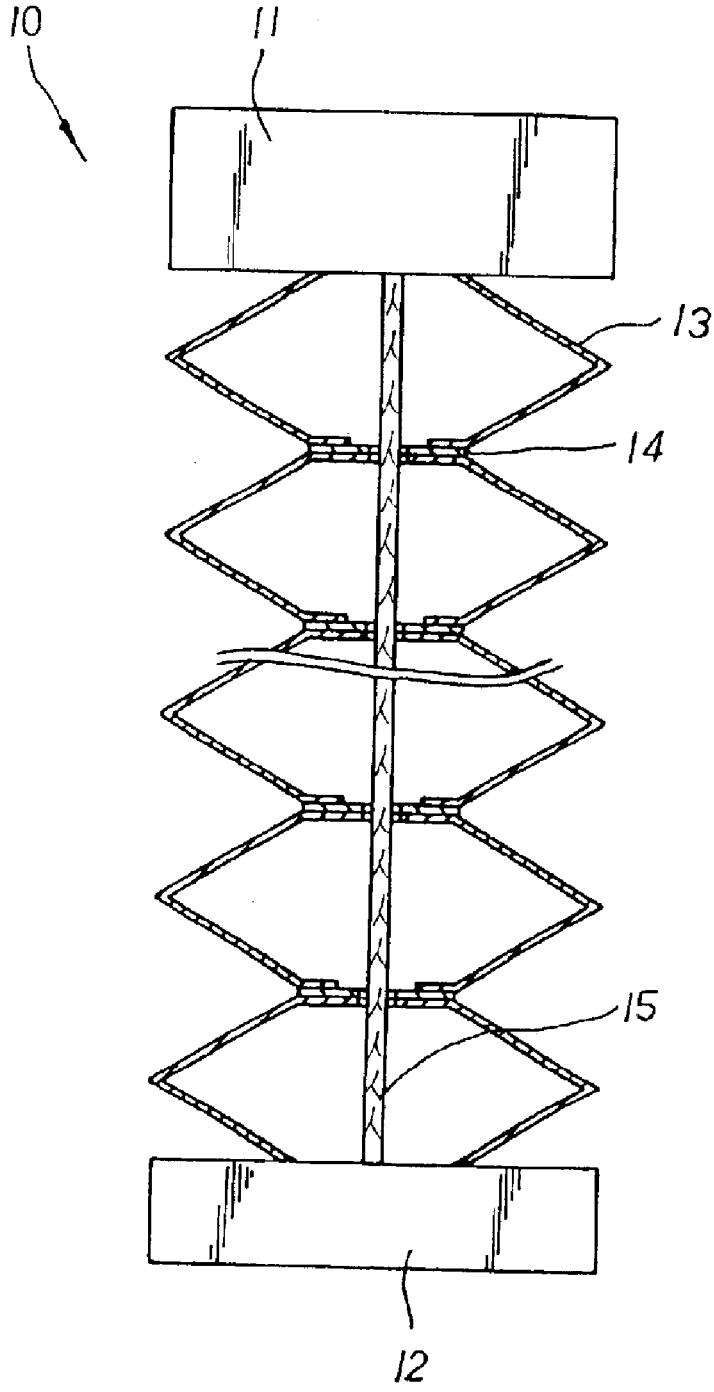
FIG. 1 PRIOR ART
FIG. 1 is a cross sectional view of a conventional hive-shaped Venetian blind.
Figure 2:
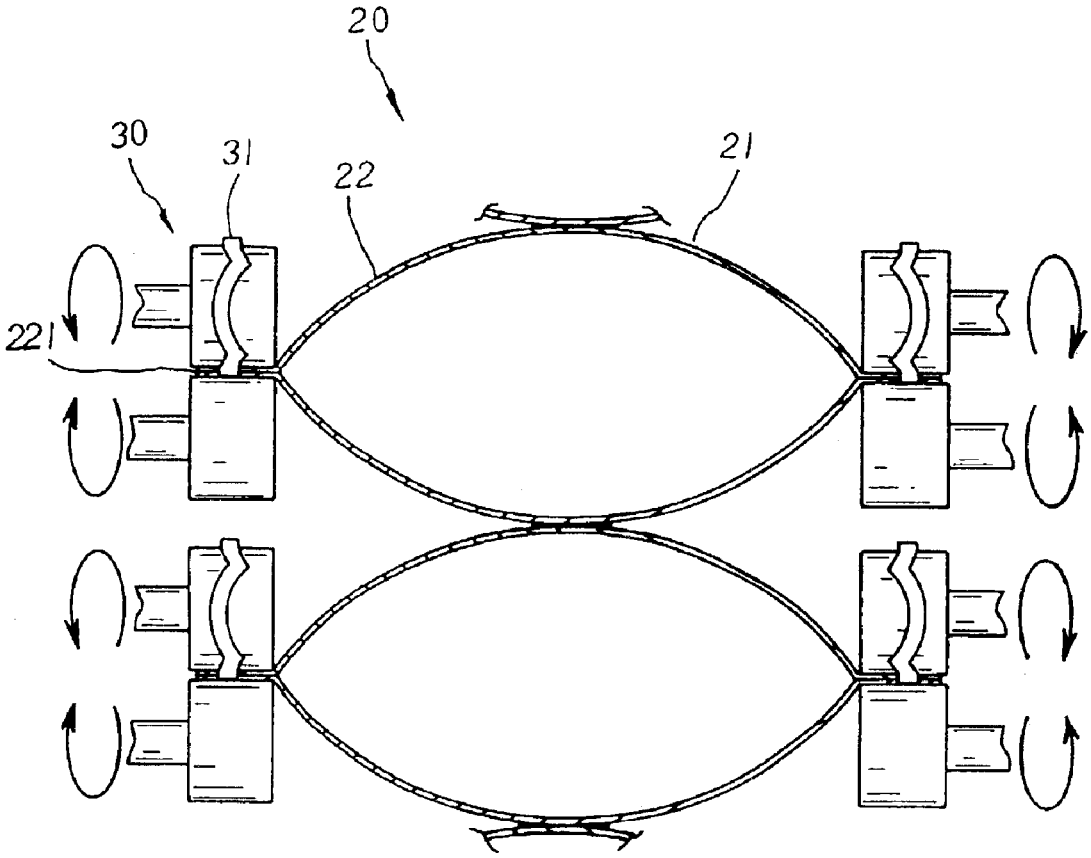
FIG. 2 is a diagram showing the present invention processed by rollers.
Figure 3:
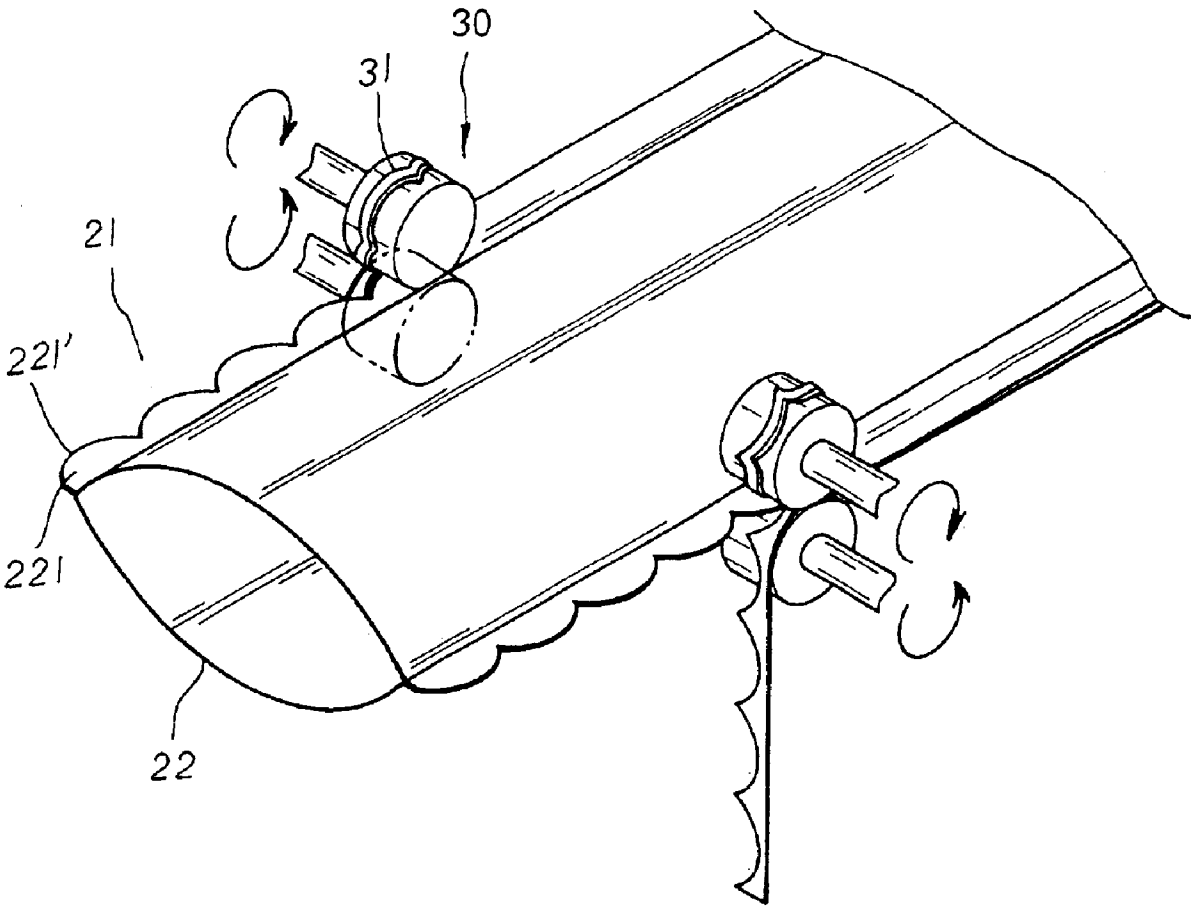
FIG. 3 is a diagram showing the present invention cut with lace-like patterns thereon.

Please refer to FIGS. 2, 3. The present invention is related to a lace-like structure of a hive-shaped Venetian blind, comprising a plurality of oval-shaped blind units 21 each made up of two wave-like arc slats 22 correspondingly combined face to face. Each of the wave-like arc slats 22 has a pair of extended flanges 221 disposed at the front and rear sides thereof Rollers 30 with lace-producing convex edges 31 disposed thereon are adapted to clamp tight the extended flanges 221 thereof and synchronically seal up the paired-up wave-like arc slats 22 thereof via ultrasonic. welding art to form oval-shaped blind units 21 as shown in FIG. 2. Meanwhile, the lace-producing convex edges 31 of the rollers 30 will cut through the extended flanges 221 thereof to produce lace-like patterns 221' at both front and rear sides of the oval-shaped blind units 21 thereof as shown in FIG. 3.

Figure 4:
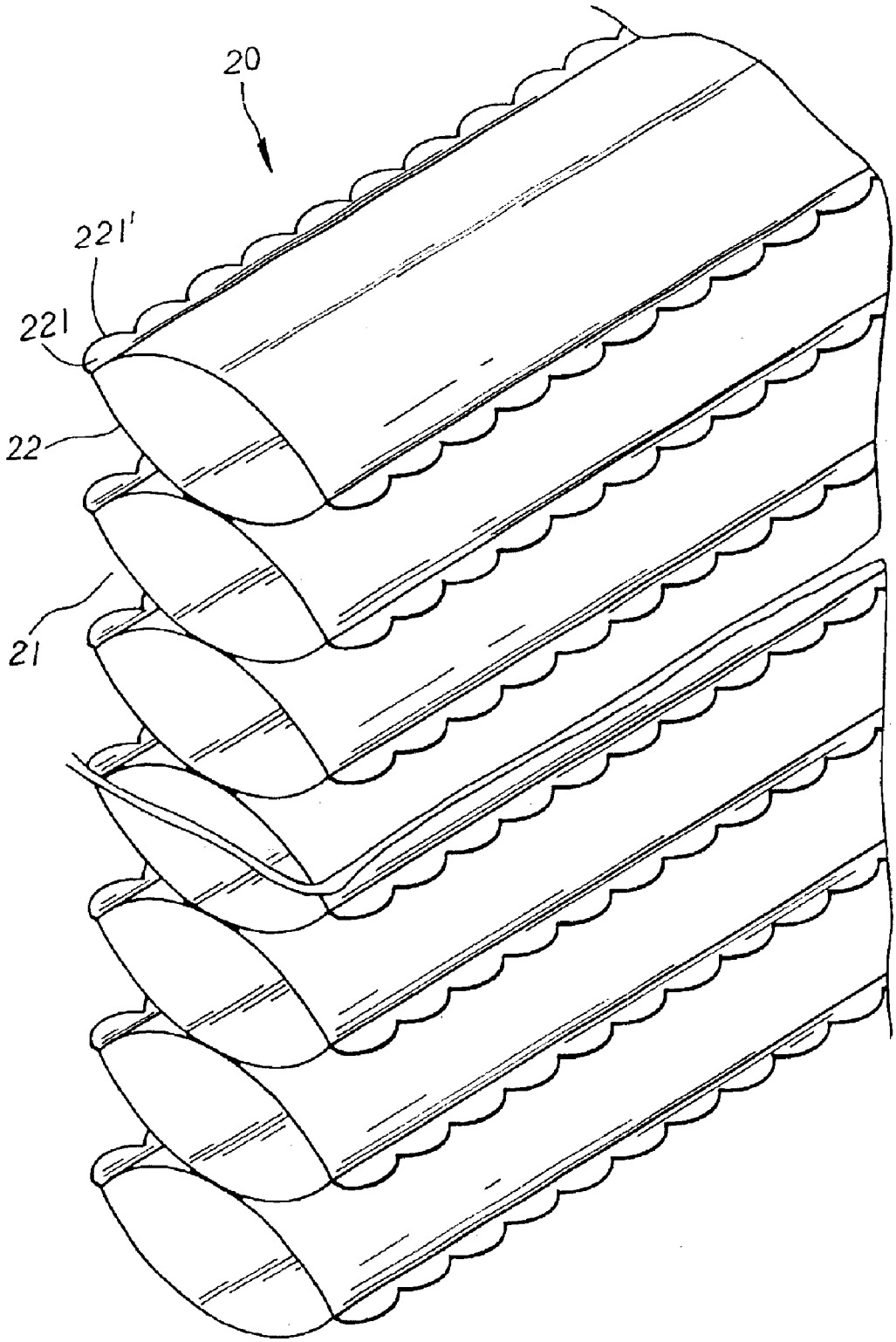
FIG. 4 is a perspective view of the present invention.

Please refer to FIG. 4. The oval-shaped blind units 21, made up of the paired-up wave-like arc slats 22 with lace-like patterns 221' cut at the extended flanges 22 thereon, are assembled to form a blind body 20 of the Venetian blind in a ready and speedy manner. Thus, via the lace-producing rollers 30, the paired-up wave-like arc slats 22 are synchronically and automatically assembled with ease and speed, facilitating the massive production of the blind body 20 thereof. Besides, the lace-like patterns 221' cut by the lace-producing convex edges 31 of the rollers 30 thereof also increase the overall beauty of the blind body 20 thereof in display.

What is claimed is:

1. A hive-shaped blind structure comprising:

a plurality of blind units, each of the plurality of blind units having two slats, each of the two slats having:

a) a curved cross section; and b) two extended flanges, each of the two extended flanges has a curved pattern cut along a length of an external edge thereof, the two extended flanges of a first slat of the two slats are connected to the two extended flanges of a second slat of the two slats with a hollow interior formed therebetween, wherein two adjacent blind units of the plurality of blind units are connected to a center of each of the plurality of bind units, the center is located between the curved pattern of each of the two extended flanges.

2. The hive-shaped blind structure according to claim 1, wherein the two extended flanges of the first slat are connected to the two extended flanges of the second slat by ultrasonic welding.

* * * * *